US007757605B2

(12) United States Patent
Kobayashi et al.

(10) Patent No.: US 7,757,605 B2
(45) Date of Patent: Jul. 20, 2010

(54) STAMP

(75) Inventors: Shinji Kobayashi, Tokai (JP); Hiromi Kitamura, Nagoya (JP); Kazuyuki Kanbe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 294 days.

(21) Appl. No.: 10/589,392

(22) PCT Filed: Mar. 16, 2005

(86) PCT No.: PCT/JP2005/004634

§ 371 (c)(1),
(2), (4) Date: Oct. 16, 2006

(87) PCT Pub. No.: WO2005/105465

PCT Pub. Date: Nov. 10, 2005

(65) Prior Publication Data

US 2007/0181014 A1 Aug. 9, 2007

(30) Foreign Application Priority Data

Apr. 28, 2004 (JP) ..... 2004-133842
Feb. 8, 2005 (JP) ..... 2005-031230

(51) Int. Cl.
*B41J 1/60* (2006.01)
*B41F 31/00* (2006.01)
*B41K 1/38* (2006.01)
*B41K 1/10* (2006.01)
*B41K 1/50* (2006.01)

(52) U.S. Cl. ..... 101/111; 101/327

(58) Field of Classification Search ..... 101/109, 101/111, 327, 103, 333, 405
See application file for complete search history.

(56) References Cited

U.S. PATENT DOCUMENTS 4,492,162 A * 1/1985 Nettesheim et al. ..... 101/103
4,594,943 A 6/1986 Nettesheim et al.
4,858,526 A * 8/1989 Bengtsson ..... 101/111

(Continued)

FOREIGN PATENT DOCUMENTS

EP 1 658 991 A1 5/2006

(Continued)

*Primary Examiner*—Ren Yan
*Assistant Examiner*—Leo T Hinze
(74) *Attorney, Agent, or Firm*—Oliff & Berridge, PLC

(57) ABSTRACT

In a fixed print portion 100, a cylindrical holding member 125 holds a fixed print member 112 and an ink storage body 113 from the side of the ink storage body 113 and a frame member 120 having an L-shaped section is set from the side of the fixed print member 112 so that it is fitted to the outer periphery of the holding member 125, thereby a print face 111 is held and exposed outside. A portion of the fixed print member 112 near the outer periphery is nipped between the frame member 120 and the holding member 125 in a compressed state because the frame member 120 is fitted to the holding member 125 and an exposed portion of the fixed print member 112 has a difference of height H between the end face of the frame member 120 and the print face 111. A damper member 300 is disposed between the frame member 120 and a flange 203 provided on a supporting case 201 of the movable print portion 200.

5 Claims, 11 Drawing Sheets

U.S. PATENT DOCUMENTS

| | | | | | |
|---|---|---|---|---|---|
| 4,970,952 | A | * | 11/1990 | Hiraga et al. | 101/111 |
| 5,819,650 | A | * | 10/1998 | Shih | 101/111 |
| 5,899,142 | A | * | 5/1999 | Suda et al. | 101/125 |
| 2006/0201354 | A1 | * | 9/2006 | Suda | 101/327 |

FOREIGN PATENT DOCUMENTS

| | | |
|---|---|---|
| JP | U 59-19360 | 2/1984 |
| JP | U 6-00769 | 1/1994 |
| JP | U 6-67049 | 9/1994 |
| JP | A-6-328828 | 11/1994 |
| JP | A-8-108606 | 4/1996 |
| JP | A-9-226219 | 9/1997 |
| JP | A 2000-318282 | 11/2000 |
| JP | A 2002-192822 | 7/2002 |
| JP | A 2005-132069 | 5/2005 |

* cited by examiner

STAMP

TECHNICAL FIELD

The present invention relates to a stamp capable of forming a print image by combining two print faces.

BACKGROUND ART

A conventional stamp capable of forming a single print image by combining two or more print faces has such a problem that the respective print faces are not flush with each other if a shift occurs in the heights of the respective print faces so that a partial unevenness may occur in a print image when they are stamped under that condition. Unless the print faces are adjusted appropriately in the case of a date stamp, there occurs problems that, for example, the date may not be recognized from the print image. In such a date stamp, a single print image is constituted by combining a print face selected from a rotary print body (movable print body) having a plurality of print faces (date portion) with a print face (company name and the like), which is a fixed print body.

For example, according to the patent document 1, both a print face of a print belt (rotary print body) and a print face of a master print body (fixed print body) are adjusted into a same plane by rotating an adjustment ring for moving the print face of the print belt in a direction of becoming flush with the print face of the master print body, with the print faces of the print belt (rotary print body) urged in a direction of becoming not flush with the print face of the master print body (fixed print body) with elastomeric members such as leaf spring or the like.

Patent document 1 Japanese Patent Application Laid-Open No. 2000-318282

DISCLOSURE OF THE INVENTION

Problem to be Solved by the Invention

However, the adjustment of the print faces needs to be carried out prior to making a stamp and the adjustment of the print faces and trial stamping need to be executed repeatedly in order to verify whether or not the adjustment of the print faces is completed, thereby taking much time and labor.

Further, there is another problem if plural print faces are formed of different materials. That is, each print face has its own optimum pressing force to be applied and thus, if print is made with a pressure appropriate for one print face, the other print face may cause blur or conversely ink may ooze out.

The present invention has been achieved to solve the above-described problem and an object of the invention is to provide a stamp capable of securing a stamp quality by applying an optimum pressure to each of the plurality of print faces.

Means for Solving the Problem

To achieve the above described object, the stamp of the present invention comprises: a first print body which is fixed to a main body case and has a first print face for forming a print image; a second print body which has an exposure hole through which the first print face is exposed and a second print face for forming the print image together with the first print face exposed through the exposure hole; and a restricting member which holds the second print body and restricts a distance in which the second print face is compressed when the main body case is pressed down at the time of making stamp.

The stamp of the present invention may further comprise a holding member which holds the second print body from an opposite side of the second print face; a frame member which nips the second print body with the holding member such that the second print face is exposed; and a damper member which makes contact with the main body case and the frame member, wherein the restricting member is constituted of the frame member and the damper member and when stamping is made, the damper member is compressed so that the frame member is pressed down and the exposed second print face is compressed until the frame member comes into contact with a stamping object medium.

The stamp of the present invention may be so constructed that the first print face is disposed at a position receding from the second print face in an opposite direction of the stamping direction when no stamping is made, and the damper member is compressed so that the first print face and the second print face become flush with each other when the main body case is pressed down at the time of making stamp.

The stamp of the present invention may be so constructed to comprise an elastic member which makes contact with the main body case and the first print body, wherein the elastic member is compressed so that the first print face and the second print face become flush with each other when the main body case is pressed down at the time of making stamp.

Effect of the Invention

In the stamp of the invention, when the main body case is pressed down to make stamping, the second print face comes into contact with the stamping object medium and when it is further pressed down, the restricting member comes into contact with the stamping object medium so that even if a further force is applied, the second print face is kept from being loaded with that force. Thus, the second print face is not loaded with any excessive force thereby causing no blur or oozing of ink. On the other hand, clear stamping can be achieved because the first print body can be loaded with a desired force.

Further in the stamp of the present invention, the second print body is held by the frame member and the holding member such that the second print face projects slightly from the frame member when no stamping is made. If the main body case is pressed down when stamping is made, the second print body is pushed down through the damper member keeping contact with the frame member and the second print face comes into contact with the stamping object medium. When it is further pushed down, the frame member makes contact with the stamping object medium, so that even if a further force is applied, the second print body is kept from being loaded with that force. That is, the second print body is compressed only by a distance equal to the projection of the second print body when no stamping is made. On the other hand, the first print body is supplied with a pressing force as it is so that it is pressed sufficiently to achieve stamping. Because no excessive force is applied to the second print body, no blur or oozing of ink occurs and because a desired force can be applied to the first print body, clear stamping can be achieved.

Because in the stamp of the present invention, the first print face is pressed down more than the second print face is, although the first print face and the second print face are not always located at an equal height, excellent stamping can be achieved with the both print faces kept flush with each other.

Because the stamp of the present invention is provided with the elastic member between the main body case and the first print body, the elastic member is compressed until the second print face and the first print face become flush with each other when the main body case is pressed down at the time of making stamp. Accordingly, an appropriate pressing force is applied to each of the first print face and the second print face even if the height is not adjusted by user upon usage, excellent stamping can be achieved.

BEST MODE FOR CARRYING OUT THE INVENTION

Figure 1:
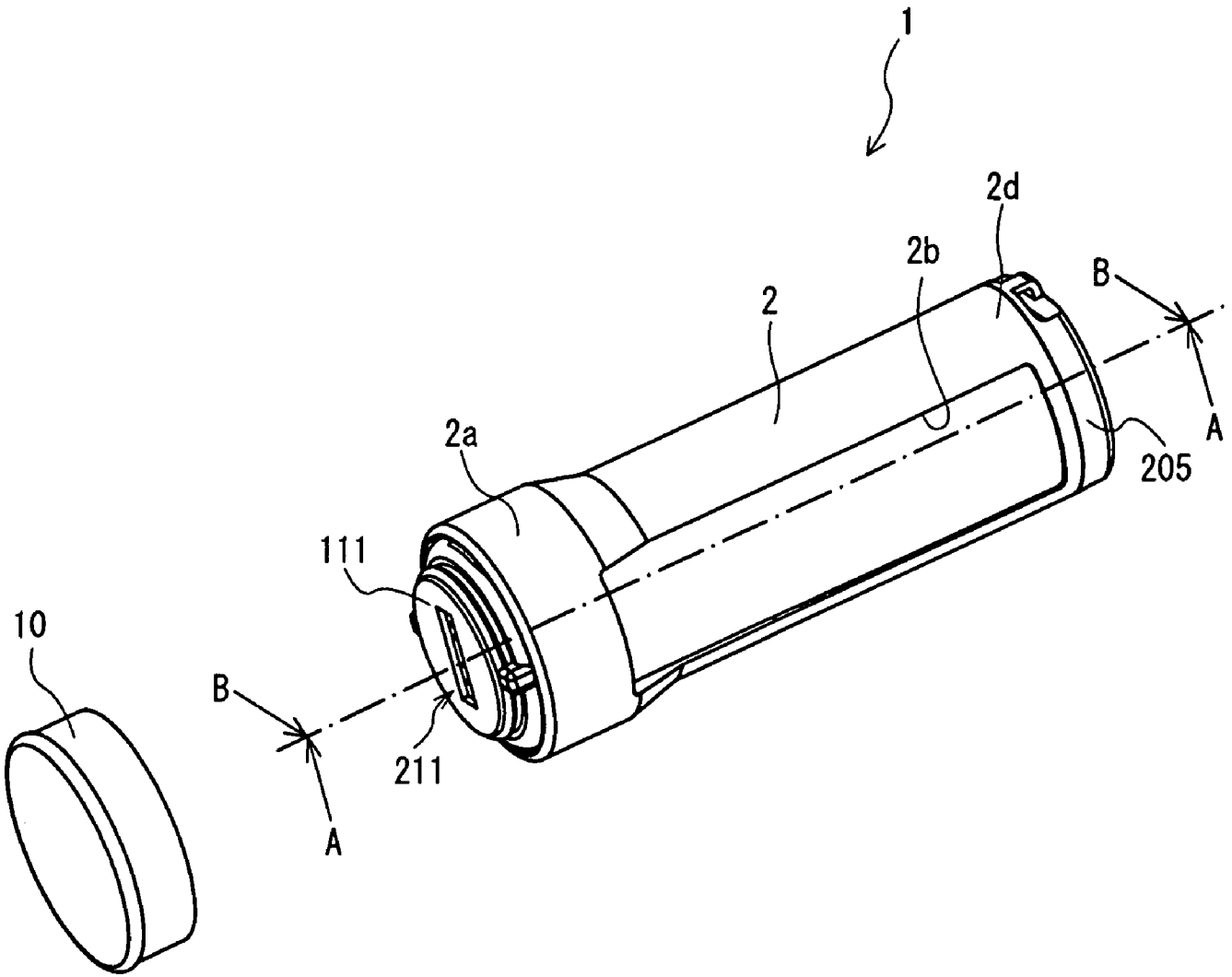
FIG. 1 is a perspective view of a date stamp 1 in a state in which it can be pressed.
Figure 2:
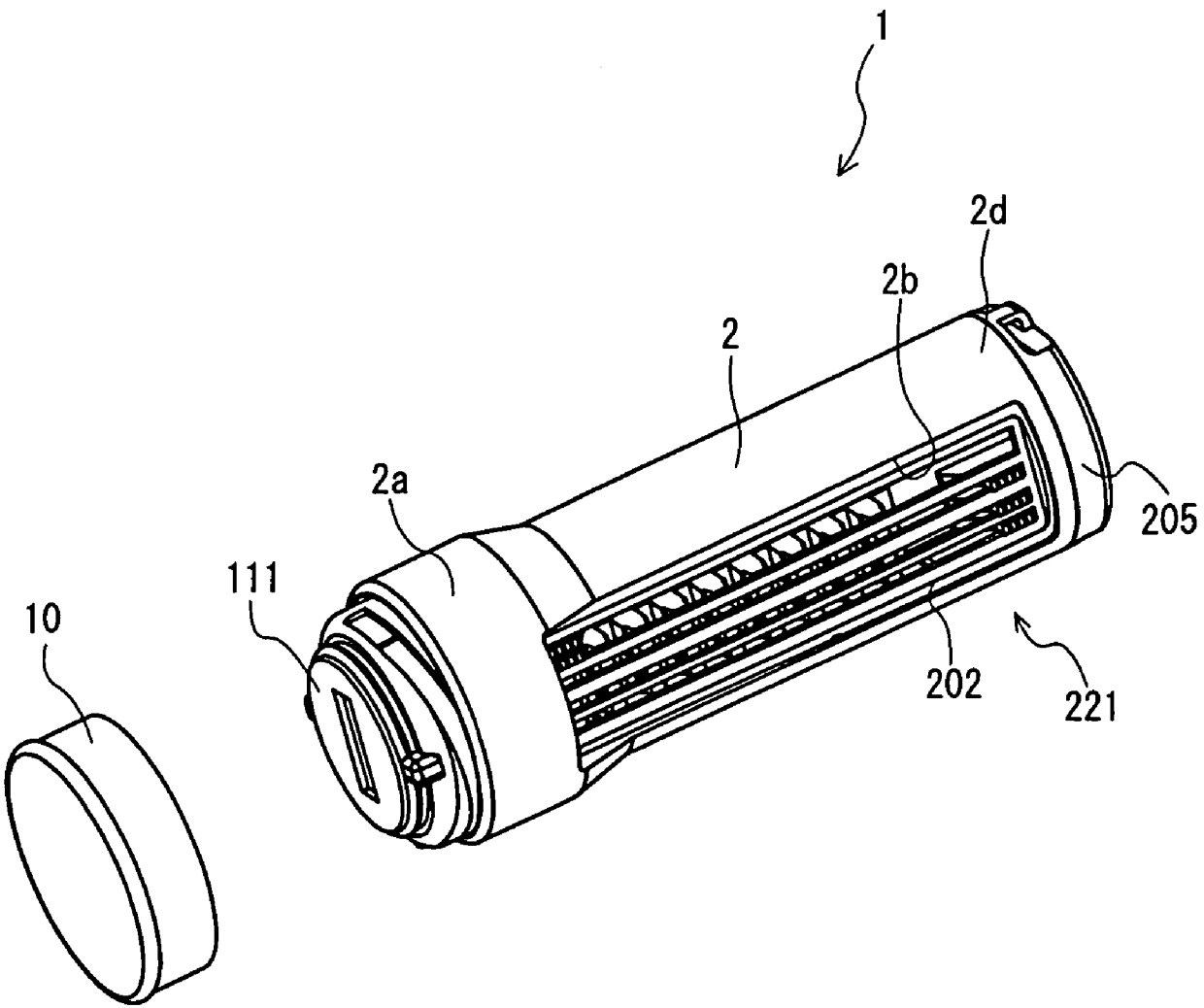
FIG. 2 is a perspective view of the date stamp 1 in a state in which the print face 211 can be changed.
Figure 3:
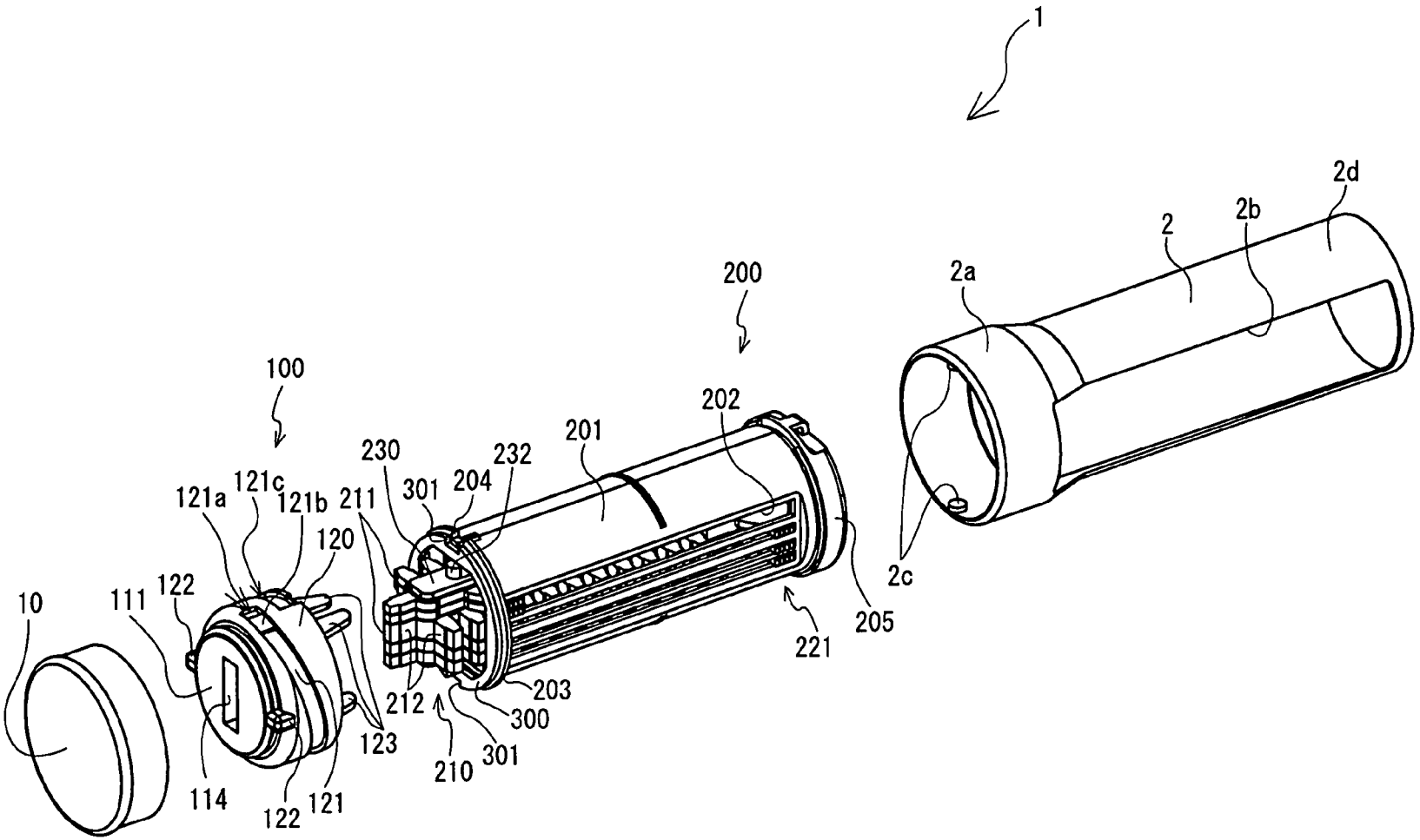
FIG. 3 is a disassembly perspective view of the date stamp 1.
Figure 4:
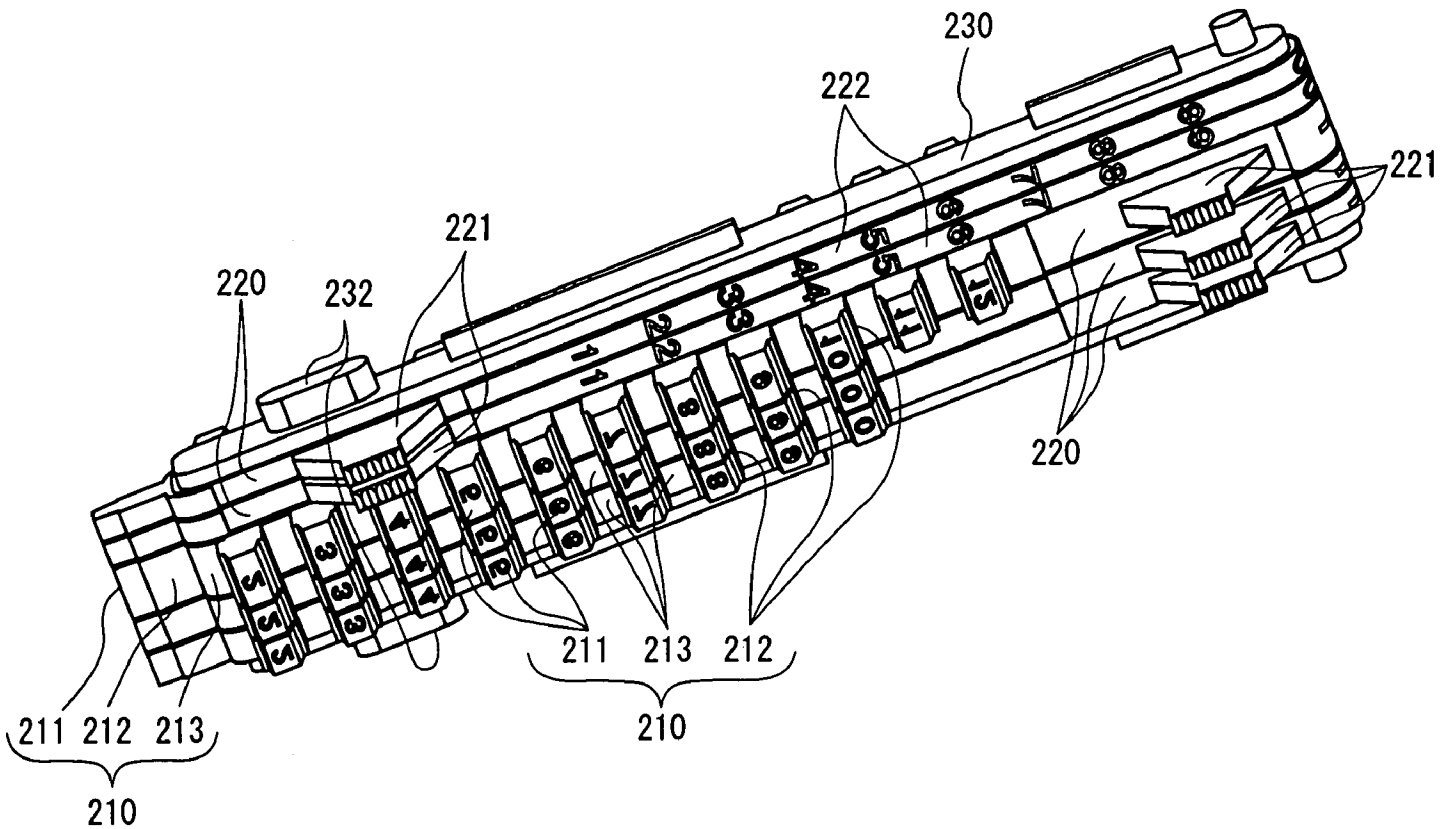
FIG. 4 is a perspective view of a holding body 230 holding a movable print member 210.
Figure 5:
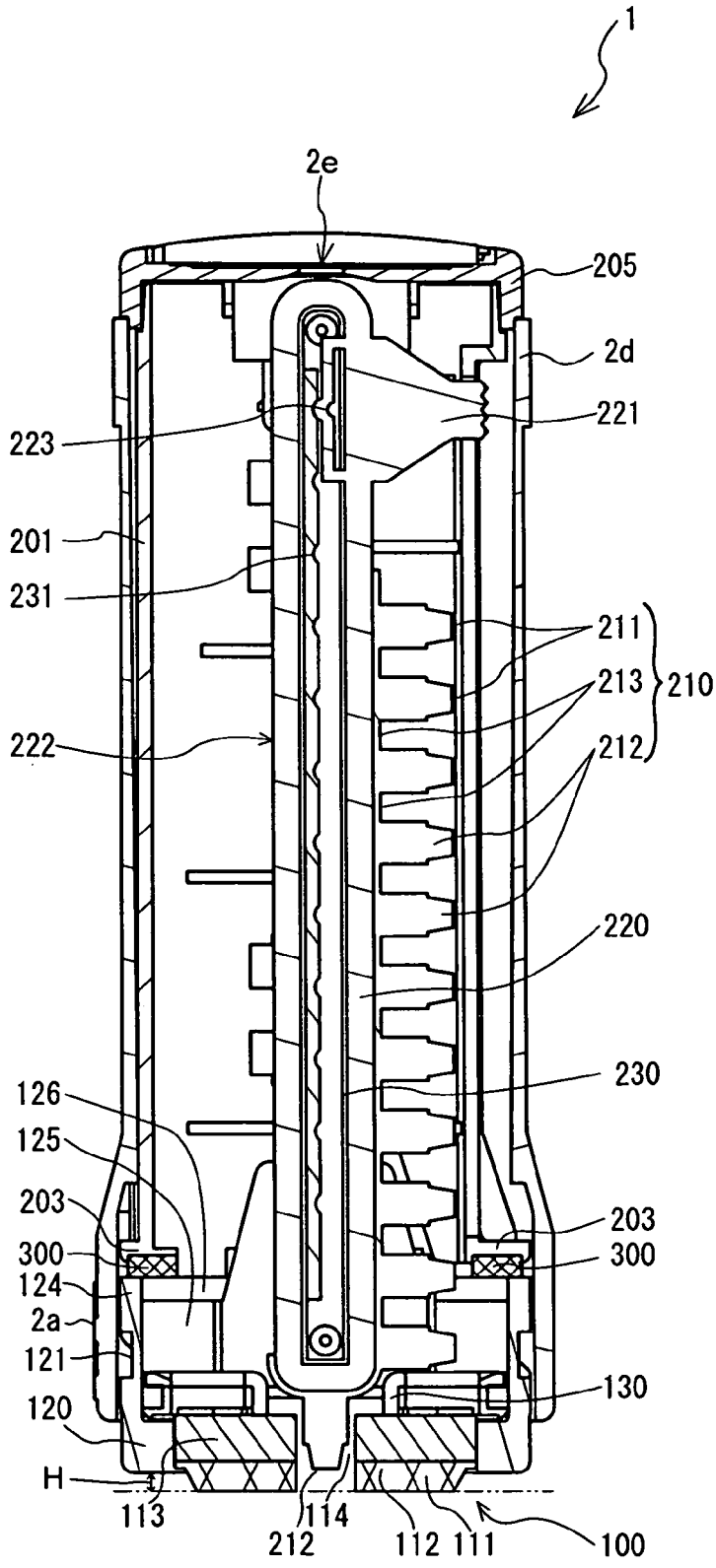
FIG. 5 is a sectional view of the date stamp 1 as seen from the direction of an arrow A with respect to a dot and dash line in FIG. 1.
Figure 6:
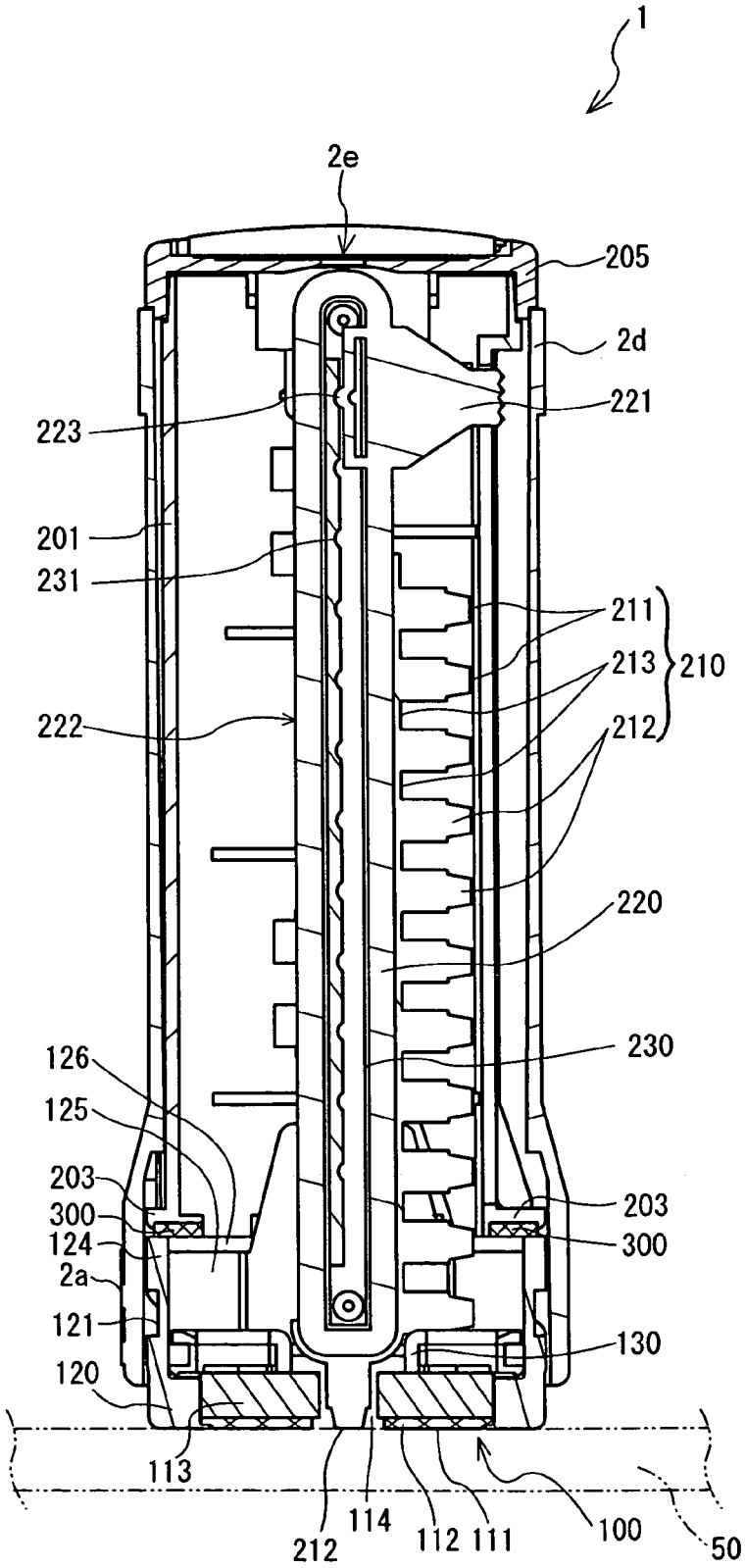
FIG. 6 is a sectional view of the date stamp 1 when stamping is made.

Hereinafter, an embodiment of the stamp of the present invention will be described about a date stamp 1. First, the first embodiment will be described with reference to FIGS. 1-6. FIG. 1 is a perspective view of the date stamp 1 in a condition which allows a stamp. FIG. 2 is a perspective view of the date stamp 1 in a condition which allows its print face 211 to be changed. FIG. 3 a disassembly perspective view of the date stamp 1. FIG. 4 is a perspective view of a holding body 230 which holds a movable print member 210. FIG. 5 is a sectional view of the date stamp 1 as seen from the direction of an arrow A with respect to a dot and dash line in FIG. 1. FIG. 6 is a sectional view of the date stamp 1 when stamp is made.

As shown in FIGS. 1 and 2, the date stamp 1 has a substantially cylindrical main body case 2 and a bore of a cylindrical end portion 2*a* on an end of the main body case 2 is made slightly larger than a body thereof. The cylindrical end portion 2*a* has a print face for forming a print image on a printing object medium. The print face is a substantially circular print face having a plane perpendicular to the axial direction of the main body case 2 and constructed to be able to form a print image by synthesizing a print face 111 whose print image is unchangeable with a print face 211 which is capable of forming a print image such as any date by combining numerals and symbols. A cap 10 for protecting the print faces 111 and 211 by covering when the date stamp 1 is not in use is provided detachably from the cylindrical end portion 2*a* of the main body case 2.

A rear end portion 205 of the movable print portion 200 (see FIG. 3) is exposed from a cylindrical end portion 2*d* on an opposite side of the cylindrical end portion 2*a* of the main body case 2. It holds the main body case 2 and when the rear end portion 205 is rotated substantially 180 degrees in the circumferential direction with respect to the main body case 2 as shown in FIG. 2, the movable print portion 200 is rotated together with the rear end portion 205. Then, a slide-type operating portion 221 is exposed from an opening portion 2*b* which is open in the outer peripheral face of the main body case 2. As described later, this operating portion 221 is used for changing the print faces 211 which are provided in plural kinds.

As shown in FIG. 3, the movable print portion 200 which holds the print faces 211 and a fixed print portion 100 which holds a print face 111 are accommodated in the main body case 2.

The fixed print portion 100 comprises a fixed print member 112 in which a print face 111 is formed (see FIG. 5) and an ink storage body 113 which makes contact with the fixed print member 112 for supplying ink and is held by a cylindrical holding member 125 (see FIG. 5) which holds the fixed print member 112 and the ink storage body 113 from the side of the ink storage body 113 and a cylindrical frame member 120 which is fitted to the outer periphery of the holding member 125 while exposing the print face 111 from the side of the fixed print member 112 and holds the fixed print member 112 and the ink storage body 113 with the holding portion 125. Then, the frame member 120 is fitted to the inner periphery of the cylindrical end portion 2*a* of the main body case 2 so that the fixed print portion 100 is accommodated in the main body case 2. Two spiral grooves 121 are provided in the outer periphery of the frame member 120 in order to close the opening of the cylindrical end portion 2*a* with the fixed print portion 100 in a condition in which the movable print portion 200 is accommodated within the main body case 2. Two bosses 2*c* provided protrudedly from the inner periphery of the cylindrical end portion 2*a* of the main body case 2 such that they oppose each other are engaged with the spiral grooves 121.

A stopper 121*b* is provided at a terminal end 121*a* of the spiral groove 121 by raising the bottom face of the spiral groove 121 and a motion of the boss 2*c* located at the terminal end 121*a* in a direction along the spiral groove 121 is restricted when the fixed print portion 100 is advanced/retreated. A stopper 121*c* is provided also at a beginning end of the spiral groove 121 and the motion of the boss 2*c* is restricted by the stopper 121*c* when the fixed print portion 100 is loosened thereby preventing the fixed print portion 100 from slipping out of the main body case 2.

The rotation angle of the fixed print portion 100 to the main body case 2, the fixed print portion 100 being rotated by moving the boss 2*c*, first located at the terminal end 121*a* of the spiral groove 121 beyond the stopper 121*b* along the spiral groove 121 until its motion is blocked by the stopper 121*c*, is constructed to be substantially 180 degrees according to this embodiment. This rotation angle is preferred to be at least 90 degrees or more to less than 270 degrees. This reason is that if the rotation angle of the fixed print portion 100 is less than 90 degrees, resistance applied to the boss 2*c* which makes sliding contact with the spiral groove 121 when the fixed print portion 100 is rotated increases because a direction of the spiral groove 121's guiding the boss 2*c* approaches the moving direction of the fixed print portion 100. Another reason is that if the rotation angle is more than 270 degrees, the main body case 2 or the fixed print portion 100 which user grips needs to be released and gripped again when user rotates the fixed print portion 100 with the main body case 2 gripped.

A pair of guide members 123 are projected in an opposite direction of the print face 111 from the inside of the frame member 120 of the fixed print portion 100. Two guide pieces 232 provided protrudedly on a side face near the short side of the holding bodies 230 of the movable print portion 200 described later are nipped between this pair of the guide members 123. Thus, the motion of the fixed print portion 100 is restricted so that it is slidable only in the axial direction. That is, when the boss 2*c* is slid along the spiral groove 121, the fixed print portion 100 is advanced or retreated in the axial direction with respect to the main body case 2.

A pair of projecting portions 122 are provided on the side face of the frame member 120 which holds the fixed print member 112 and the ink storage body 113. The projecting portions 122 engage each engaging portion (not shown) provided on the inside face of the cap 10. A substantially rectangular exposure hole 114 which goes through the fixed print portion 100 in a direction perpendicular to the face of the print face 111 is made substantially in the center of the print face 111 of the fixed print portion 100. The exposure hole 114 is a hole which exposes the print face 211 of the movable print member 210 from the main body case 2. The aforementioned projecting portions 122 are provided on the side faces of the frame member 120 on both sides in the short side direction of the exposure hole 114. The fixed print portion 100 corresponds to a second print body of the present invention and the print face 111 corresponds to a second print face.

Next, the movable print portion 200 supports the holding body 230 which holds the movable print member 210 within a cylindrical supporting case 201. As shown in FIG. 4, the movable print member 210 is fixed on the outer peripheral face of each of five belt bodies 220 supported individually in parallel rotatably along the length direction of the substantially rectangular holding body 230 such that it is moved with rotations of the belt bodies 220. The movable print member 210 is provided projectingly on the outer peripheral face of the belt body 220 and a plurality of print portions 212 having a print face 211 at its front end are provided in parallel along the rotation direction of the belt bodies 220 and the roots of the respective print portions 212 are connected through a joint portion 213. The length of this movable print member 210 is less than half of the length of the belt body 220. The print portion 212 having the print face 211 and the joint portion 213, which constitute this movable print member 210, is composed of ink soaking body such as porous resin and formed integrally. In the meantime, the movable print member 210 corresponds to a first print body of the present invention and the print face 211 corresponds to a first print face.

The operating portions 221 which are operated to rotate each belt body 220 individually are provided protrudedly on the outer peripheral face of the belt body 220 and the belt body 220 can be rotated by sliding the operating portion 221 along the length direction of the holding body 230. A print image sample 222 corresponding to the print face 211 of each print portion 212 is printed on the outer peripheral face on an opposite side of a side in which the movable print member 210 is fixed, of the belt body 220. When any print portion 212 is located on a side face in the length direction of the holding body 230 as a result of operating the operating portion 221, the example 222 of a print image corresponding to that print face 211 is located on the other side face. A sample window 2*e* (see FIG. 5) is made in the bottom face of the rear end portion 205 of the movable print portion 200, so that the sample 222 located on the other side face in the length direction of the holding body 230 can be seen through the sample window 2*e*.

As shown in FIG. 5, a projecting portion 223 is provided projectingly on the operating portion 221 of the belt body 220, the projecting portion 223 being urged such that it is capable of advancing/retreating in a direction perpendicular to the sliding direction of the operating portion 221. Recess portions 231 for positioning when engaging the projecting portion 223 to apply a load to a rotation of the belt body 220 are provided by the same quantity as the print portions 212 along the rotation direction of the belt body 220 on the inside face of the holding body 230. This structure aims at positioning the belt body 220 so that the print portion 212 corresponding to the recess portion 231 is positioned on a side face in the length direction of the holding body 230 when the projecting portion 223 is engaged with the recess portion 231. The respective print portions 212 of the five belt bodies 220 positioned in this manner are arranged in parallel and when the movable print portion 200 is accommodated in the main body case 2 and closed with the fixed print portion 100, inserted into the exposure window 114 such that their parallel arrangement direction coincides with the length direction of the exposure hole 114. At this time, the guide members 123 of the fixed print portion 100 nip the guide piece 232 on the holding body 230 of the movable print portion 200 and the fixed print portion 100 is positioned with respect to the movable print portion 200. Consequently, the parallel arrangement direction of the print portion 212 meets the length direction of the exposure hole 114.

As described previously, the supporting case 201 is formed cylindrically in conformity of the inner periphery of the accommodated main body case 2 (see FIG. 3). As shown in FIGS. 3, 5, a flange 203 is provided at an end portion on the side of the print face of the supporting case 201 projectingly in a direction perpendicular to the outer peripheral face so that a flat face parallel to the direction perpendicular to the axial direction of the main body case 2 for accommodating the supporting case 201 is formed. The outer periphery of the flange 203 is substantially equal to the inner periphery of the cylindrical end portion 2*a* of the main body case 2 having a larger bore diameter than that of the body. Two cutout portions 204 are provided in the flange 203 to eliminate an interference with the bosses 2*c* when the supporting case 201 is accommodated into the main body case 2. A ring-like damper member 300 having a substantially same shape as the plane of the flange 203 is disposed between the fixed print portion 100 and the flange 203.

As shown in FIG. 3, four elongated guide grooves 202 are opened in the axial direction in a side face of the supporting case 201. When the holding body 230 is accommodated in the supporting case 201, the operating portions 221 of the two belt bodies 220 near an end of the respective operating portions 221 (see FIG. 4) of the five belt bodies 220 are projected outwardly of the supporting case 220 through the same guide groove 202 and the operating portions 221 of the remaining three belt bodies 220 are projected from independent guide grooves 202. Further, when the supporting case 201 is accommodated in the main body case 2 so that the print faces can be changed as shown in FIG. 2, all the four guide grooves 202 are exposed through the opening portion 2*b*.

Next, the detailed structure of the fixed print portion 100 and supply of ink to the fixed print portion 100 and the movable print portion 200 will be described. As shown in FIG. 5, in the fixed print portion 100, the cylindrical holding member 125 holds the fixed print member 112 and the ink storage body 113 from the side of the ink storage body 113 and holds the print face 111 of the fixed print member 112 such that the print face 111 is exposed by driving in the frame member 120 having a substantially L-shaped section so that it is fitted to the outer periphery of the holding member 125. A portion of the fixed print member 112 near the outer periphery is nipped by the frame member 120 and the holding member 125 in a compressed state by driving the frame member 120 into the holding member 125 and a difference of height H is generated between an end face of the frame member 120 and the print face 111 in an exposed portion of the fixed print member 112.

The ink storage body 113 is composed of, for example, porous resin, which can store ink by being soaked with ink internally. The fixed print member 112 is also composed of porous resin and the print face 111 is formed by exposing the porous resin to light with a portion to turn to a print image of the fixed print member 112 masked according to a conventional method so that the exposed portion is melted to clog pores. The fixed print member 112 is supplied with ink from the ink storage body 113.

Ink carrying body 130 is provided on a face on an opposite side of the face making contact with the fixed print member 112 of the ink storage body 113 such that it makes contact with the print portion 212 of the movable print member 210 while it keep contact with the ink storage body 113. The ink carrying body 130 is composed of for example, felt and carries ink penetrating to the ink storage body 113 of the fixed print portion 100 using capillary phenomenon to the print portion 212 of the movable print member 210 which makes contact with the ink carrying body 130 for supply of ink. Ink carried from the ink storage body 113 by the ink carrying body 130 diffuses entirely into the movable print member 210 entirely composed of ink soaking body so that ink is conveyed to the respective print portions 212.

Next, an adjusting mechanism of pressure applied to the fixed print portion 100 and the movable print portion 200 when stamp is made will be described. As described previously, the damper member 300 formed in a ring shape substantially same as the plane of the flange 203 is provided at an end portion of the supporting case 201 (see FIG. 3). This blocks the damper member 300 from interfering with the holding body 230 which holds the movable print member 210 supported by the supporting case 201. The damper member 300 has two cutout portions 301 corresponding to the two cutout portions 204 in the flange 203. If the cutout portions 301 in the damper member 300 are matched with the cutout portions 204 in the flange 203 when the main body case 2 is assembled, the bosses 2 do not interfere when the supporting case 201 is installed in the main body case 2.

As shown in FIG. 5, the face of the damper member 300 on an opposite side of the flange 203 makes contact with a rear end 124 of the frame member 120. That is, because the holding member 125 of the fixed print portion 100 is formed at a lower position apart by a gap 126 than the frame member 120, the damper member 300 does not make contact with the holding member 125 although it makes contact with the frame member 120. Therefore, when user gripping the main body case 2 applies a force in a stamping direction, the holding member 125 is not pressed directly although the damper member 300 is compressed and the frame member 120 is pressed against a stamping object medium 50 (see FIG. 6), and consequently, the fixed print member 112 is protected from being pressed so more than necessary that ink held internally is oozed out.

The supporting case 201 is supported rotatably in a circumferential direction when it is accommodated in the main body case 2. At this time, an edge of the rear end portion 205 exposed from the cylindrical end portion 2*d* of the main body case 2 comes into contact with the cylindrical end portion 2*d* of the main body case 2 thereby restricting the supporting case 201 from moving in a direction to the cylindrical end portion 2*a* of the main body case 2. Further, the supporting case 201 is restricted from moving in a direction to the cylindrical end portion 2*d* of the main body case 2 by the flange 203 because the body portion of the main body case 2 is smaller than the cylindrical end portion 2*a* in diameter.

When the date stamp 1 having such a structure is assembled, as shown in FIG. 3, first, the supporting case 201, from which the separable rear end portion 205 is separated, is inserted into the main body case 2 from the side of the cylindrical end portion 2*a* of the main body case 2 and then, the rear end portion 205 is engaged with the supporting case 201 from the side of the cylindrical end portion 2*d* and fixed thereto. Then, the bosses 2*c* on the main body case 2 are engaged with the spiral groove 121 in the fixed print portion 100 while forcing the two guide pieces 232 of the holding bodies 230 in between a pair of the guide members 123 of the fixed print portion 100 from the side of the cylindrical end portion 2*a* so as to install the fixed print portion 100. All the four guide grooves 202 are exposed through the opening portion 2*b* as shown in FIG. 2 where the boss 2*c* engaged with the spiral groove 121 from a beginning end of the spiral groove 121 rides over the stopper 121*c* and at this time, a print face 211 selected of the movable print member 210 remains pulled out of the exposure hole 114 in the fixed print portion 100. If the operating portion 221 is operated with this condition, an arbitrary print face 211 can be selected.

Next, the boss 2*c* is slid along the spiral groove 121 by rotating the fixed print portion 100. If the fixed print portion 100 is rotated at this time, the supporting case 201 is also rotated because the guide pieces 232 are nipped between the guide members 123. Therefore, this procedure can be executed by rotating the rear end portion 205 of the supporting case 201 with respect to the main body case 2. If the bosses 2*c* are guided by the spiral groove 121, as shown in FIG. 1, the fixed print portion 100 is moved in a direction of being accommodated into the main body case 2 and when the boss 2*c* rides over the stopper 121*b* of the spiral groove 121 and reaches the position of an end, as shown in FIG. 5, the fixed print portion 100 is positioned to the main body case 2.

To change the print face 211, the rear end portion 205 is rotated with the main body case 2 held in the same manner as when the date stamp 1 is assembled, so that the bosses 2*c* are slid along the spiral groove 121. Then, the fixed print portion 100 is advanced or retreated in the axial direction of the main body case 2 as described previously. When the fixed print portion 100 is moved into a state which permits stamping, the fixed print portion 100 and the movable print portion 200 do not approach each other quickly thereby reducing load applied to the damper member 300 sandwiched therebetween, because the direction of spiral groove 121's guiding the bosses 2*c* is inclined with respect to the advancement/retraction direction of the fixed print portion 100 (axial direction of the main body case 2).

By the way, there exists no wall on the side of the print face at the terminal end 121*a* of the spiral groove 121. A range in which the fixed print portion 100 can move in the axial direction of the cylindrical main body case 2 when the boss 2*c* is located at the terminal end 121*a* is up to a position where the boss 2*c* makes contact with the wall face of the spiral groove 121 in terms of a direction to the cylindrical end portion 2*a* of the main body case 2 and up to a position where the rear end 124 of the frame member 120 makes contact with the flange 203 in terms of a direction to the cylindrical end portion 2*d* of the main body case 2. The damper member 300 is so constructed that the thickness thereof when it is not compressed is larger than a range in which the fixed print portion 100 can move. Therefore, when the date stamp 1 is in a state which allows stamping, the damper member 300 always makes contact with the rear end 124 of the frame member 120 of the fixed print portion 100 and the flange 203 of the movable print portion 200 and at the same time presses both of them in directions of bringing them away. Consequently, when stamping is not made, the print face 111 of the movable print member 100 movable in the axial direction of the main body case 2 is projected more in a stamping direction than the print face 211 of the movable print member 210 supported by the supporting case 201 restricted from moving in the axial direction of the main body case 2. Further, the fixed print portion 100 is pressed by the damper member 300 so that the bosses 2*c* of the main body case 2 keep contact with the wall face of the spiral groove 121, thereby preventing the fixed print portion 100 from being loosened.

This damper member 300 is formed of elastic soft member such as polyurethane foam, felt. As described previously, the fixed print member 112 and the movable print member 210 are formed of porous resin and the damper member 300 is formed of elastic material whose reaction increases as its compression amount increases. The thickness of the damper member 300 needs to be so set that a difference of thickness between at the maximum compression time and non-compression time of the damper member 300 (absorptive dimension) is larger than the movable range of the fixed print portion 100.

When the date stamp 1 is used for stamp as shown in FIG. 6, the print face is pressed against the stamping object medium 50 with the main body case 2 gripped. At this time, the print face 111 of the fixed print member 112 projecting more than the print face 211 of the movable print member 210 makes contact with the stamping object medium 50 in advance so that the fixed print member 112 receives a reaction at a stamping time. The damper member 300 more flexible than the fixed print member 112 absorbs more reaction by providing with the aforementioned difference of hardness and thus, is more compressed than the fixed print member 112. If the damper member 300 is compressed so that its thickness decreases, the fixed print portion 100 is moved in the direction to the cylindrical end portion 2*d* of the main body case 2. Then, the print portion 212 of the movable print member 210 of the movable print portion 200 restricted from moving with respect to the main body case 2 is moved relatively in a direction of projecting from the exposure hole 114. Then, the print face 111 of the fixed print member 112 and the print face 211 of the movable print member 210 become flush with each other on the surface of the stamping object medium 50.

When a further pressure is applied to the stamping object medium 50, the damper member 300 is compressed further so that the print portion 212 is moved in a direction of projecting further from the exposure hole 114. Because the frame member 120 holding the fixed print member 112 holds the fixed print member 112 such that it projects by an amount H as shown in FIG. 5 from the print face 111 of the fixed print member 112, the fixed print member 112 is restricted from being compressed further although the frame member 120 reaches the stamping object medium 50 and is compressed just by the height H. Thus, a pressure of a level desired by user is applied to the print portion 212 of the movable print member 210 and the pressure to the fixed print member 112 is restricted by the frame member 120. Consequently, a print image without any blur or oozing of ink can be formed.

In the date stamp 1 of this embodiment as described above, the damper member 300 is provided between the fixed print portion 100 and the movable print portion 200 and the print face 111 of the fixed print portion 100 is projected in the stamping direction with respect to the print face 211 of the movable print portion 200. When stamping is made, the print face 111 comes into contact with the stamping object medium in advance of the print face 211 and the damper member 300 more flexible than the fixed print member 112 is compressed more largely than the fixed print member 112 by a reaction from the stamping object medium. Consequently, the print face 111 and the print face 211 become flush with each other on the surface of the stamping object medium 50, so that no unevenness occurs in a print image produced by synthesizing the print face 111 and the print face 211.

Even when user intensifies the pressing force to obtain a clearer print image by the print face 211, the compression of the fixed print member 112 is restricted at a position where the frame member 120 makes contact with the stamping object medium because the damper member 300 keeps contact with only the frame member 120 holding the fixed print member 112 at a position projecting by a compression distance H from the print face 111. Therefore, no ink held within the fixed print member 112 is oozed out by an excessive pressing force or leaks out of the exposure hole 114. Consequently, the stamping object medium is protected from contamination and a clear print image can be obtained.

Needless to say, the present invention may be modified in various ways. Although the movable print member 210 is formed of porous resin, it is not restricted to this example but may be formed of porous rubber, metal, ceramics or the like. Although according to this embodiment, two print faces are combined, if three or more print faces are combined, it is permissible to fix one of them and adjust the other ones with a damper member so that the print faces become flush on the same plane when stamping is made.

The movable print member 210 may be detachable and combined with the print face 111 of the fixed print portion 100 so as to form a single print face. Further, the exposure hole 114 for exposing the print portion 212 of the movable print member 210 is not restricted to a hole but may be a cutout and any structure may be adopted if the side faces of the fixed print member 112 and the ink storage body 113 oppose the print portion 212.

Although the shape of the damper member 300 is set into a substantially same shape as the flange 203 of the supporting case 201, the damper member 300 and the flange 203 may be of different shapes if the volume of the damper 300 does not increase when it is compressed or there is provided a sufficient distance for the damper member 300 not to make contact with the inner face of the main body case 2 when it is compressed in a vertical direction and expanded in the right and left directions.

Figure 7:
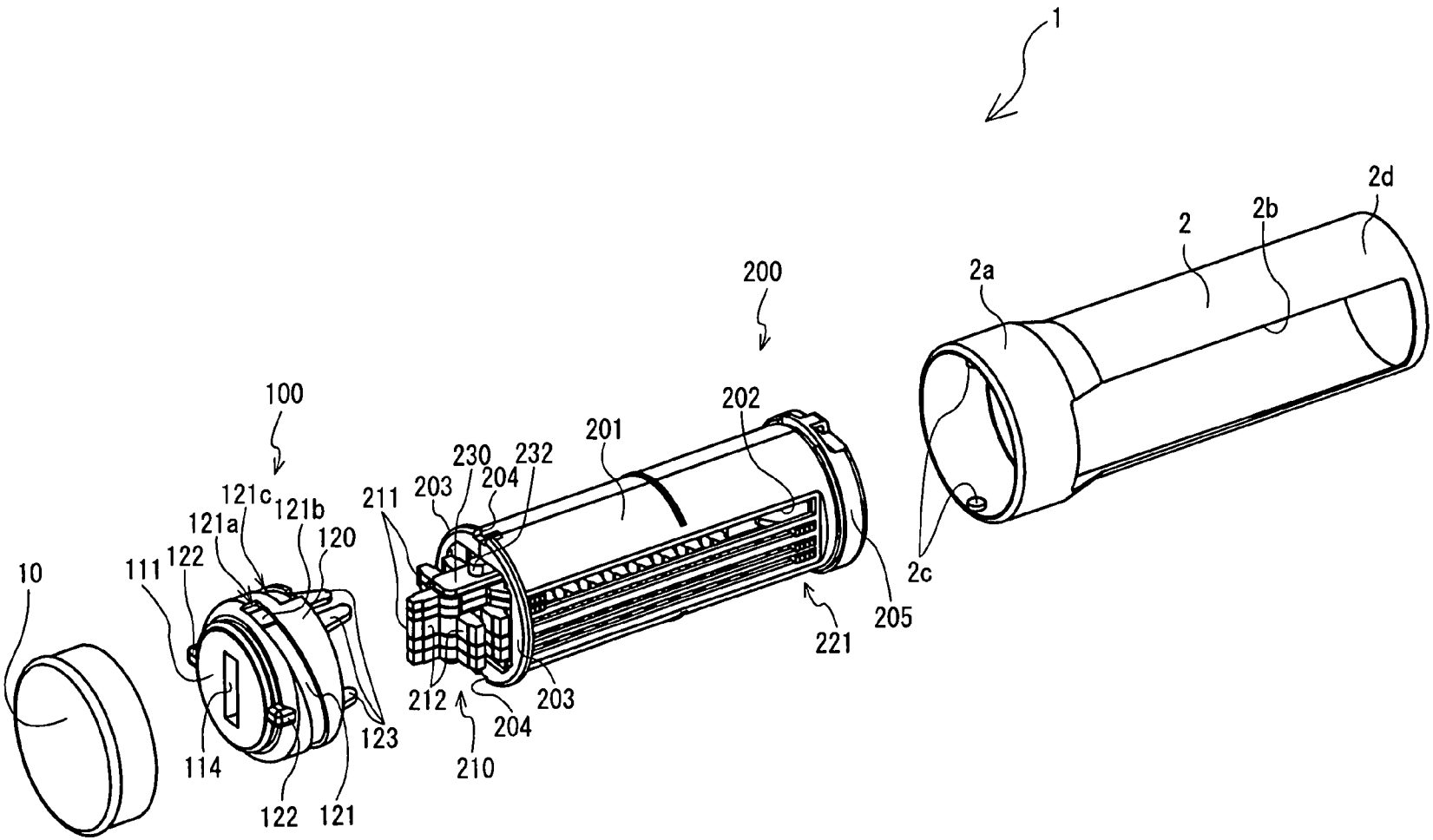
FIG. 7 is a disassembly perspective view of the date stamp 1 according to a second embodiment.
Figure 8:
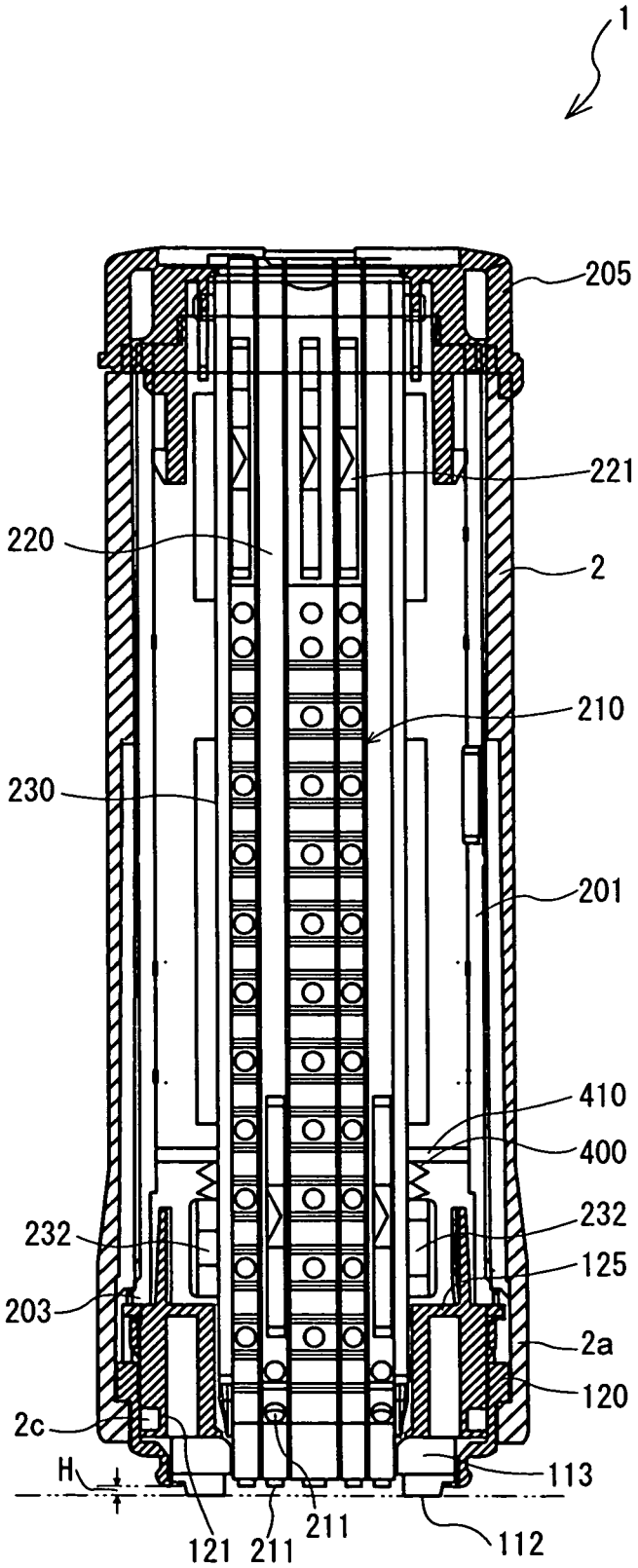
FIG. 8 is a sectional view of the date stamp 1 of the second embodiment as seen from the direction of an arrow B with respect to the dot and dash line in FIG. 1.
Figure 9:
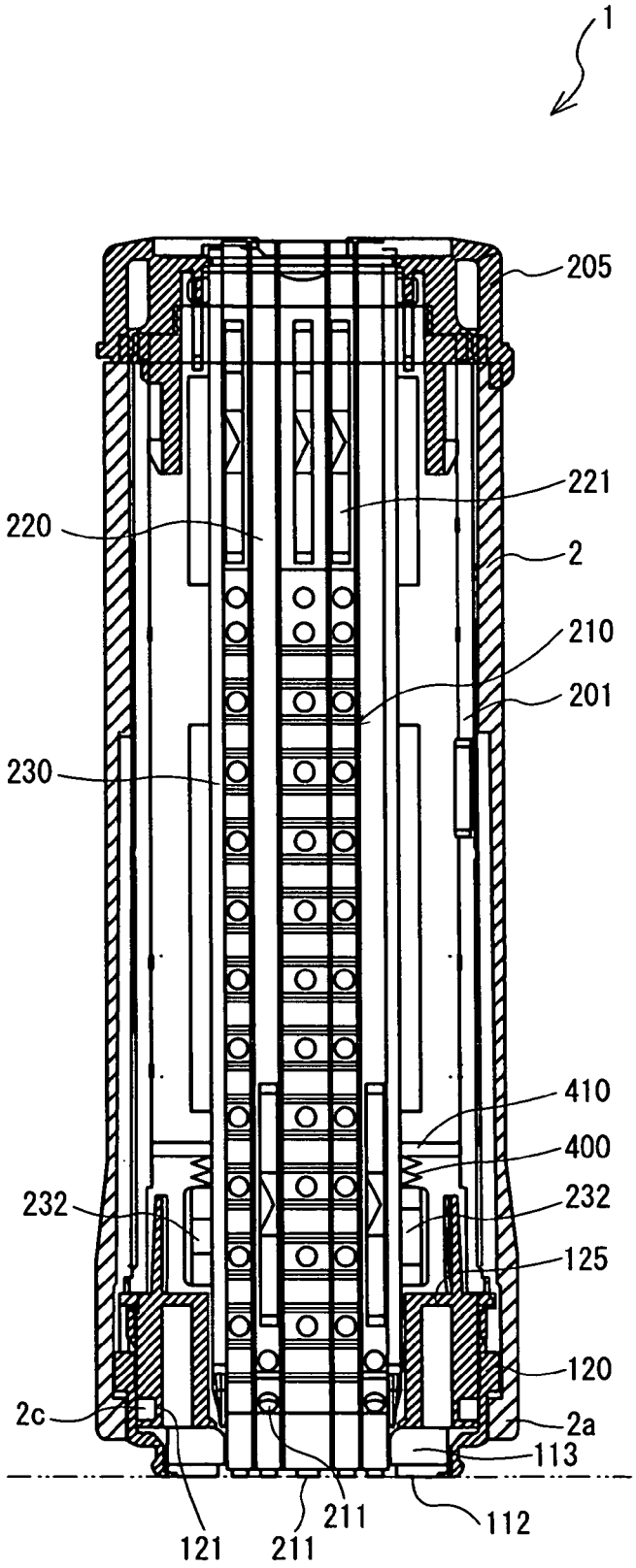
FIG. 9 is a sectional view of the date stamp 1 of the second embodiment when stamping is made.

Next, the second embodiment of the present invention will be described with reference to FIGS. 7-9. FIG. 7 is a disassembly perspective view of the date stamp 1 of the second embodiment. FIG. 8 is a sectional view of the date stamp 1 of the second embodiment as seen from the direction of an arrow B with respect to a dot and dash line of FIG. 1. FIG. 9 is a sectional view of the date stamp 1 of the second embodiment when stamping is made. In the second embodiment, the present invention is applied to the date stamp 1 like the first embodiment. Therefore, the description of the first embodiment about FIGS. 1, 2, 4 and corresponding drawings is used in a following description and like reference numerals are attached to the same components as the first embodiments in FIGS. 7-9 while description thereof is omitted.

Although the date stamp 1 of the second embodiment is substantially the same as the date stamp 1 of the first embodiment as shown in FIG. 7, no damper member 300 is provided between the fixed print portion 100 and the flange 203. Thus, unlike the first embodiment, the fixed print portion 100 is restricted from moving in the axial direction with respect to the main body case 2 because it is never pressed by the damper member 300. As shown in FIG. 8, the supporting case 201 holding the movable print member 210 has a rib 410 projecting to the holding body 230 on its inner side near an end on the side of the print face. Springs 400 as an elastic member are provided between two guide pieces 232 projecting in the short side direction of the holding body 230 and the rib 410. An end of the spring 400 is fixed to the main body case 2 through the supporting case 201 by the rib 410 and the other end thereof is fixed to the first print body 200 by the guide piece 232. As a consequence, the print face 211 of the movable print portion 200 is urged to the side of the main body case 2 by the spring 400 so that it is located at a position slightly receding from the print face 112 of the fixed print portion 100 into the inside of the main body case when no stamping is made. According to the second embodiment, a pressing force to the fixed print portion 100 and the movable print portion 200 when stamping is made is adjusted with the spring 400.

That is, if a force is applied in the stamping direction with the print face pressed against the stamping object medium by user gripping the main body case 2 when stamping is made with the date stamp 1, the rib 410 inside the supporting case 201 presses the guide piece 232 through the spring 400 and thus, the print portion 212 of the movable print member 210 is moved in a direction of projecting from the exposure hole 114 as shown in FIG. 9. On the other hand, the print face 111 of the fixed print member 112 comes into contact with the stamping object medium first because it is projected relative to the print portion 212 of the movable print member 210. However, the fixed print member 112 is compressed by the height H because the frame member 120 holds the fixed print member 112 such that it is projected by the height H from the print face 111 of the fixed print member 112 and it is restricted from being compressed further after the frame member 120 reaches the stamping object medium. Then, because the movable print member 210 is projected from the exposure hole 114 with the spring 400 compressed as shown in FIG. 9, the print face 111 of the fixed print member 112 and the print face 211 of the movable print member 210 become flush with each other on the surface of the stamping object medium.

In the date stamp 1 of the second embodiment, as described above, no damper member 300 is provided between the fixed print portion 100 and the movable print portion 200 and the spring 400 is provided between the supporting case 201 and the movable print portion 200. As a consequence, the movable print portion 200 is movable with respect to the main body case 2 while the fixed print portion 100 is fixed. Because when stamping is made, the frame member 120 restricts a compression distance of the fixed print member 112 although the print face 111 comes into contact with the stamping object medium in advance of the print face 211 and on the other hand, the movable print member 200 is projected from the exposure hole 114 with the spring 400 compressed, the print face 111 of the fixed print member 112 and the print face 211 of the movable print member 210 become flush with each other on the surface of the stamping object medium. Further, because the spring 400 is compressed to absorb an excess amount of the pressing force of user, oozing of ink or blur is unlikely to occur on the print face 111 and the print face 211. Therefore, no unevenness occurs in a print image produced by synthesizing the print face 111 and the print face 211 even if height adjustment or trial stamp is not carried out by user, thereby securing a clear print image.

Although according to the second embodiment, the spring 400 is used as the elastic member of the present invention, it is not restricted to a spring but may be rubber, polyurethane foam or the like as long as it is elastic. Further, the mounting position of the spring 400 is not restricted to between the rib 410 and the guide piece 232 but it may be disposed such that it is contracted/expanded in the axial direction of the main body case 2 with an end and the other end thereof kept in contact with the supporting case 201 and the movable print member 210 respectively.

Figure 10:
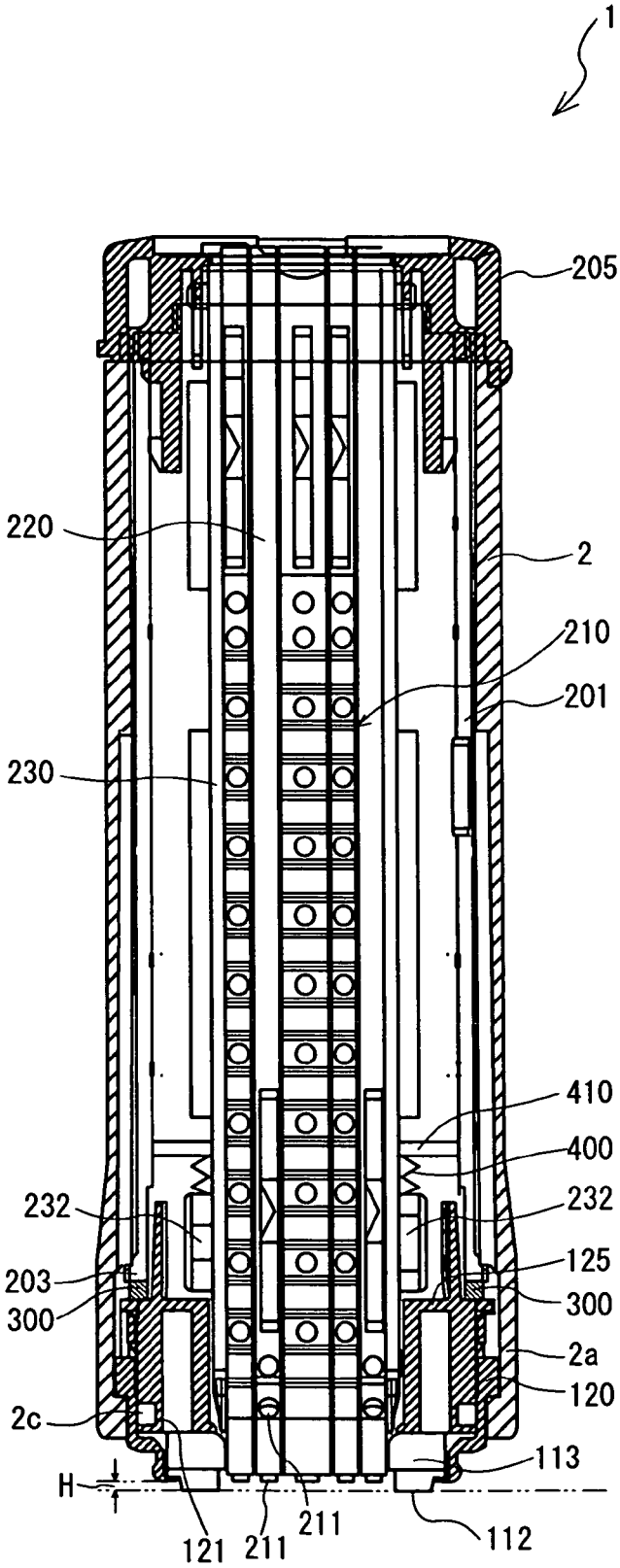
FIG. 10 is a sectional view of the date stamp 1 of the third embodiment as seen from the direction of the arrow B with respect to the dot and dash line in FIG. 1.
Figure 11:
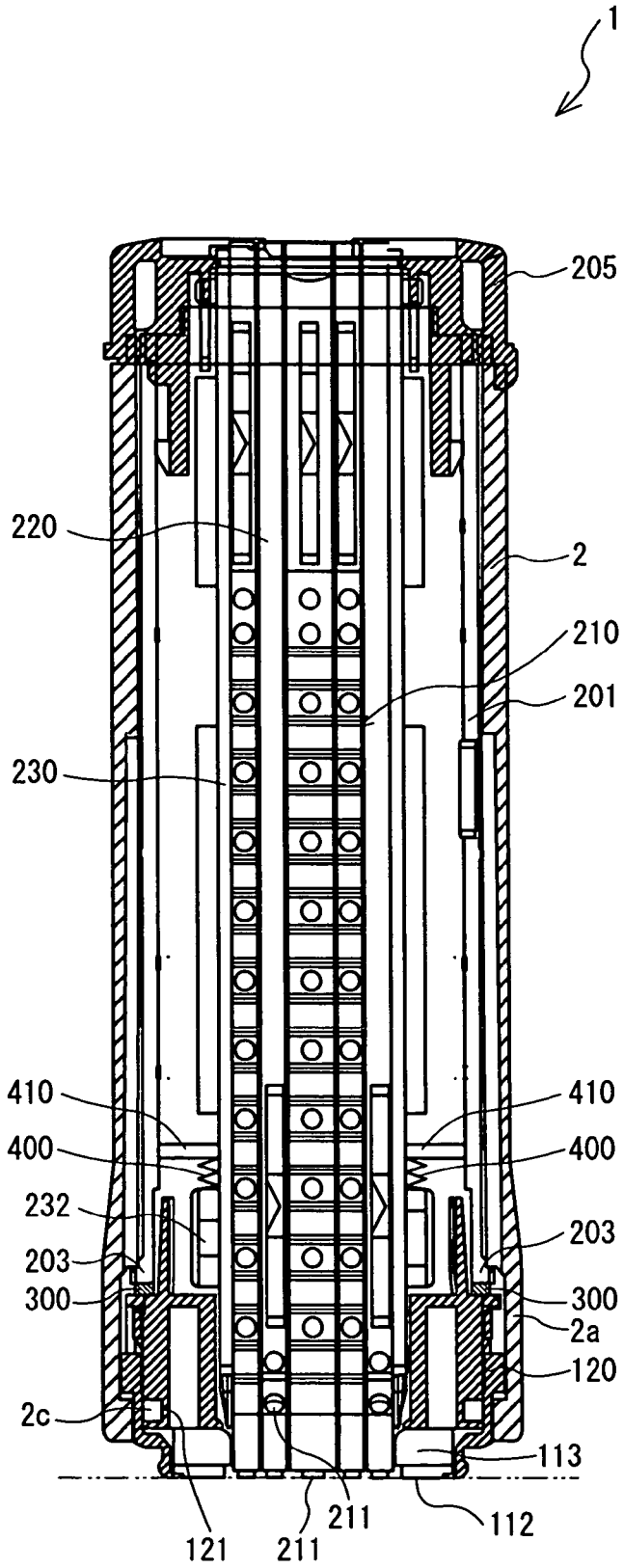
FIG. 11 is a sectional view of the date stamp 1 of the third embodiment when stamping is made.

Next, the third embodiment of the present invention will be described with reference to FIGS. 10, 11. FIG. 10 is a sectional view of the date stamp 1 of the third embodiment as seen from the direction of an arrow B with respect to a dot and dash line in FIG. 1. FIG. 11 is a sectional view of the date stamp 1 of the third embodiment when stamping is made. In the third embodiment, the present invention is applied to the date stamp like the first and second embodiments. Therefore, in a following description, the description of the first embodiment about FIGS. 1, 2, 3, 4 and corresponding drawings is used and like reference numerals are attached to the same components as the first and second embodiments in FIGS. 10, 11 while description thereof is omitted.

As shown in FIG. 10, the date stamp 1 of the third embodiment is substantially the same as the date stamp 1 of the first embodiment and the second embodiment. That is, the date stamp of the third embodiment has the damper member 300 like the first embodiment and has a rib 410 projecting to the holding body 230 inside near an end on the side of the print face of the supporting case 201 holding the movable print member 210 like the second embodiment. A spring 400 which is an elastic member is provided between two guide pieces 232 projecting from the side face in the short side direction of the holding body 230 and the rib 410. Thus, when the date stamp 1 can be pressed, the damper member 300 always keep contact with the rear end 124 of the frame member 120 of the fixed print portion 100 and the flange 203 of the movable print portion 200 while at the same time pressing them in a direction of departing from each other. An end of the spring 400 is fixed to the main body case 2 through the supporting case 201 by the rib 410 and the other end thereof is fixed to the first print body 200 by the guide piece 232, so that the print face 211 of the movable print portion 200 is always urged toward the main body case 2 by the spring 400. According to the third embodiment, adjustment of pressing force on the fixed print portion 100 and the movable print portion 200 when stamping is made is carried out through both the damper member 300 and the spring 400.

If user gripping the main body case 2 applies a force in the stamping direction with its print face pressed against a stamping object medium when he presses the date stamp 1, as shown in FIG. 11, the print face 111 of the fixed print member 112 projecting relative to the print face 211 of the movable print member 210 comes into contact with the stamping object medium 50 in advance and the fixed print member 112 receives a reaction force from the stamping object medium 50 when stamping is made. However, the damper member 300 more flexible than the fixed print member 112 absorbs the reaction more because there is provided a difference of hardness between the fixed print member 112 and the damper member 300 as described in the first embodiment, so that the damper member 300 is compressed more than the fixed print member 112. When the damper member 300 is compressed so that its thickness decreases, the fixed print portion 100 is moved in a direction to the cylindrical end portion **2*d* of the main body case 2. When the main body case 2 is pressed against the stamping object medium, the rib 410 inside the supporting case 201 pushes the guide piece 232 through the spring 400 so that the print portion 212 of the movable print member 210 is moved in the direction of projecting from the exposure hole 114. Because the fixed print member 112 and the movable print member 210 are movable with respect to the main body case 2, adjustment of the height is carried out by both the fixed print member 112 and the movable print member 210 and consequently, the print face 111 of the fixed print member 112 and the print face 211 of the movable print member 210** become flush with each other on the surface of the stamping object medium.

When a further pressure is applied to the stamping object medium 50, the damper member 300 is compressed further so that the print portion 212 is moved in a direction of projecting out of the exposure hole 114. However, when the frame member 120 reaches the stamping object medium 50, the fixed print member 112 is compressed only by the height H because the frame member 120 holding the fixed print member 112 holds the fixed print member 112 such that it is projected only by the height H from the print face 111 of the fixed print member 112, however it is restricted from being compressed further. Therefore, a pressure of a level desired by user is applied to the print portion 212 of the movable print member 210 and the pressure to the fixed print member 112 is restricted by the frame member 120, so that a print image without any blur or oozing of ink can be formed.

DESCRIPTION OF REFERENCE NUMERALS

1: date stamp
2: main body case
50: stamping object medium
100: fixed stamp portion
111: print face
112: fixed print member
114: exposure hole
120: frame member
125: holding member
200: movable print portion
210: movable print member
211: print face
212: print portion
300: damper member
400: spring
410: rib

The invention claimed is:

1. A stamp comprising:

a first print body which is fixed to a main body case and has a first print face for forming a print image;

a second print body which has an exposure hole through which the first print face is exposed and a second print face for forming the print image together with the first print face exposed through the exposure hole;

a restricting member which holds the second print body and restricts a distance in which the second print face is compressed when the main body case is pressed down at the time of making stamp;

a holding member which holds the second print body from an opposite side of the second print face;

a frame member which nips the second print body with the holding member such that the second print face is exposed; and a damper member which makes contact with the main body case and the frame member, wherein:

the restricting member includes the frame member and the damper member and when stamping is made, the damper member is compressed so that the frame member is pressed down and the exposed second print face is compressed until the frame member comes into contact with a stamping object medium;

the holding member is located at a lower position in the stamp apart by a gap from the damper member; and a face of the damper member on an opposite side of a flange of the main body case makes contact with an end of the frame member.

2. The stamp according to claim 1 wherein the first print face is disposed at a position receding from the second print face in an opposite direction of the stamping direction when no stamping is made, and the damper member is compressed so that the first print face and the second print face become flush with each other when the main body case is pressed down at the time of making stamp.

3. The stamp according to claim 1 further comprising an elastic member which makes contact with the main body case and the first print body, wherein the elastic member is compressed so that the first print face and the second print face become flush with each other when the main body case is pressed down at the time of making stamp.

4. The stamp according to claim 1, wherein compression of the exposed second print face is restricted at a position where the frame member makes contact with the stamping object medium because the damper member keeps contact with only the main body case and the frame member.

5. The stamp according to claim 1, wherein:

the gap is configured such that the damper member is prevented from making contact with the holding member and when stamping is made the main body case applies force in the stamping force direction such that the holding member is not pressed directly although the damper member is compressed and the frame member is pressed against the stamping object medium.

* * * * *